US005917454A

United States Patent [19]

Hill et al.

[11] Patent Number: 5,917,454

[45] Date of Patent: Jun. 29, 1999

[54] SLOTTED RING SHAPED ANTENNA

[75] Inventors: Robert J. Hill, Fremont; Eric C. Krantz, San Francisco, both of Calif.

[73] Assignee: Trimble Navigation Limited, Sunnyvale, Calif.

[21] Appl. No.: 08/916,888

[22] Filed: Aug. 22, 1997

[51] Int. Cl.[6] ..... H01Q 13/12

[52] U.S. Cl. ..... 343/769; 343/770; 343/767

[58] Field of Search ..... 343/769, 770, 343/767, 768, 746, 872; H01Q 13/12

[56] References Cited

U.S. PATENT DOCUMENTS

| | | | |
|---|---|---|---|
| 3,293,645 | 12/1966 | Farley et al. | 343/708 |
| 3,475,755 | 10/1969 | Bassen et al. | 343/705 |
| 3,810,183 | 5/1974 | Krutsinger et al. | 343/770 |
| 3,914,767 | 10/1975 | Jones, Jr. | 343/708 |
| 4,451,830 | 5/1984 | Lucas et al. | 343/770 |
| 5,754,143 | 5/1998 | Warnagiris et al. | 343/767 |

*Primary Examiner*—Hoanganh Le
*Attorney, Agent, or Firm*—Wagner, Murabito & Hao

[57] ABSTRACT

An antenna for radiating toroidally is disclosed. The antenna may be fabricated to conform with any size of system. The antenna may be placed around an electronics package or a structure to radiate toroidally around the electronics package or structure. The antenna is formed of a strip of copper which includes a number of slots. The slots are disposed longitudinally within the strip of copper such that, upon the application of power to the copper strip, the antenna radiates toroidally. A method for making an antenna that conforms to the size and shape of a particular system is also disclosed.

18 Claims, 14 Drawing Sheets

SLOTTED RING SHAPED ANTENNA

TECHNICAL FIELD

The present claimed invention relates to the field of antennas. More specifically, the present claimed invention relates to an improved antenna for toroidal radiation.

BACKGROUND ART

In global positioning system (GPS) based surveying or Geographic Information System (GIS) data collection applications, it is common to employ a number of GPS receivers which share satellite observables. The means for sharing this data is usually via a terrestrial radio link. The GPS receiver processesor and terrestrial radio link form a GPS system.

A typical GPS system network includes a GPS system located on a piece of machinery or a vehicle which receives telemetry data from satellites which is processed via an electronics package located within the GPS system. The GPS system transmits data to other GPS systems and to a fixed observer site. The GPS system also receives and processes data from other GPS systems and from the fixed observer site. Data is transmitted to and received from other GPS systems and the fixed observer site via a Radio network antenna. An antenna is required so as to assure effective data transfer irrespective of the movement or rotation of a given GPS system. The radiation pattern is particularly important since GPS systems are typically used in outdoor environments such as in surveying, moving vehicles, etc. where the orientation of one GPS unit relative to other GPS units and systems is difficult to obtain.

Prior art antennas for Radio networks require the connection of numerous small components. Typically, eight to ten patch antennas are individually fabricated and each antenna is attached to a radio network housing. The attachment of patch antenna to the radio network housing is typically done manually. Each patch antenna must be carefully aligned and exactly placed so as to assure a uniform antenna radiation pattern. Each patch antenna must then be attached to a power source. This is typically accomplished by coupling each patch antenna to a designated point on a parallel feed network circuit. The parallel feed network circuit is coupled to the electronics package which is coupled to the power source. Electrical coupling of each patch antenna to the parallel feed network is typically accomplished by soldering one end of a wire to each patch antenna and soldering the other end of the wire to a point on the parallel feed network circuit.

Patch antenna systems are difficult to design. In particular, in order to design a patch antenna system that will fit into a given container, individual patch antennas radiating at the desired frequency are placed circularly within a housing of the GPS system. In the past, this system has worked relatively well since patch antennas have been used in systems which radiate at a set frequency which is in the range of 2.44 GigaHertz. Due to the high frequency range of the radiation, design of patch antennas conforming to relatively small sizes of containers has been possible.

Recently, there has been a need to place patch antennas around electronics packages within a housing in order to minimize the size of GPS systems and components. This also results in products which are easier to handle and easier to use and which are more durable. Typically, recent prior art GPS systems have been made which have diameters of less than 24 inches. In many cases, depending on the product, such systems are much smaller than 24 inches in diameter.

The process of fabricating patch antenna systems and individual patch antennas is costly and time consuming. Not only is the process of connecting each individual patch antenna to the GPS system housing and to the parallel feed network costly and time consuming; but also, the process of designing a patch antenna array is costly and time consuming. The process of designing patch antenna arrays for different products is particularly time consuming since each size of housing requires a different number of patch antennas. In addition, when an antenna is placed around an electronics package, the pattern of the antenna is negatively affected. In most cases, the uniform characteristics of the resulting pattern is destroyed. In order to compensate for the electronics package, the antenna is typically placed one quarter wavelength away from the electronics package. Though this compensates for the deleterious effects of the electronics package on the antenna's pattern, it increases the size of the resulting product.

Though it would be possible to make patch antenna arrays which operate at the lower frequency ranges, such systems are impractical due to the large size requirements of such systems. Thus, patch antennas which operate in lower frequencies such as, for example, the 450 megahertz range are typically not feasible when the antenna must be integrated into the housing. However, such systems may be manufactured by using a separate antenna which connects to the GPS system or by using an antenna which projects from the top of the GPS system (e.g. a conventional dipole antenna). However, such dipole antennas are not desirable since they do not provide sufficient bandwidth or gain and since they may be easily damaged or broken and it degrades the performance of the GPS antenna that receives satellite signals.

What is needed is a simple antenna which will radiate uniformly and which can be designed to fit into nearly any given size of container. The antenna needs to be durable and reliable and inexpensive to manufacture and assemble. More specifically, an antenna system which will radiate a uniform pattern azimuthally and which will reliably operate in difficult environments such as those presented by mounting the antenna on heavy machinery and vehicles is required. Also, an antenna having a broad bandwidth which is easy and inexpensive to make is required.

DISCLOSURE OF THE INVENTION

The present invention meets the above need with an antenna which can fit into the small housing of a GPS system and which radiates at higher frequency ranges. The antenna of the present invention may be designed to operate within a broad frequency range and can conform to the needs of any size of container.

A slot antenna which is disposed circularly and which radiates in a toroidal pattern is disclosed. In one embodiment, the antenna is disposed within a housing around an electronic device which is a Data receiver and transmitter unit. Both the Data receiver and transmitter unit and the housing are roughly cylindrically shaped. A power cable connects across an antenna slot (hereinafter referred to as the driven slot). This may be accomplished by soldering a wire to a point above the driven slot and soldering a wire to a point below the driven slot. This allows for easy and inexpensive coupling of the antenna to the power source by contact to a single area of the antenna strip. The power applied to the driven slot is conducted radially around the antenna strip. The resulting antenna includes a minimum number of parts which are easily assembled and which are durable and more reliable than prior art antenna components.

In one embodiment, multiple slots are used to conform with the size requirements of a given housing. In this embodiment, one or more parasitic slots are formed within the antenna strip. These additional slots are powered parasitically as a result of the current flow from the driven slot.

The antenna may be configured to any size of container while still providing a toroidal radiation pattern at a desired frequency. The antenna is configured to any given size of housing by varying the size of the antenna strip and the number of slots, the location of slots and the size of slots within the antenna strip. The antenna may be designed to resonate at varying frequencies. This allows for the flexible formation of an antenna to meet the needs of any size of container or electronics package.

The problems of reflection resulting from the placement of the antenna around an electronics package may be overcome by placing the slot antenna at a distance of one quarter of a wavelength from the electronics package as is typically done in prior art systems. However, this adds to the size of the GPS system.

In one embodiment of the present invention, an antenna which compensates for the reflection resulting from the placement of the antenna around an electronics package is disclosed. Also disclosed is a method for making an antenna that radiates toroidally and which compensates for the reflection resulting from the placement of the antenna around an electronics package is disclosed. This antenna and method does not require a one quarter wavelength spacing as is required in prior art systems. Thus the antenna may be placed much closer to the electronics package. This results in a smaller housing and a smaller product.

In one embodiment an antenna is placed around an elecronics package which is a GPS position determination system. In one embodiment the GPS position determination system includes a GPS receiver which broadcasts and receives signals through the antenna so as to share satellite observables and correction data for accurately determining position. Techniques for obtaining position information from the satellite signals is found in Tom Logsdon, *The Navstar Global Positioning System*, Van Nostrand Reinhold, 1992, pp. 17–90, incorporated by reference herein. Reference to a Global Positioning System or GPS herein refers to a Global Positioning System, to a GLONASS system, and to any other compatible satellite based system that provides information by which an observers position and/or the time of observation can be determined. Further information regarding GPS position determination is contained in U.S. Pat. No. 5,519,620 by Nicholas Talbot et al. entitled CENTIMETER ACCURATE GLOBAL POSITION SYSTEM RECEIVER FOR ON-THE-FLY REAL TIME KINEMATIC MEASUREMENT AND CONTROL which is incorporated herein by reference.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
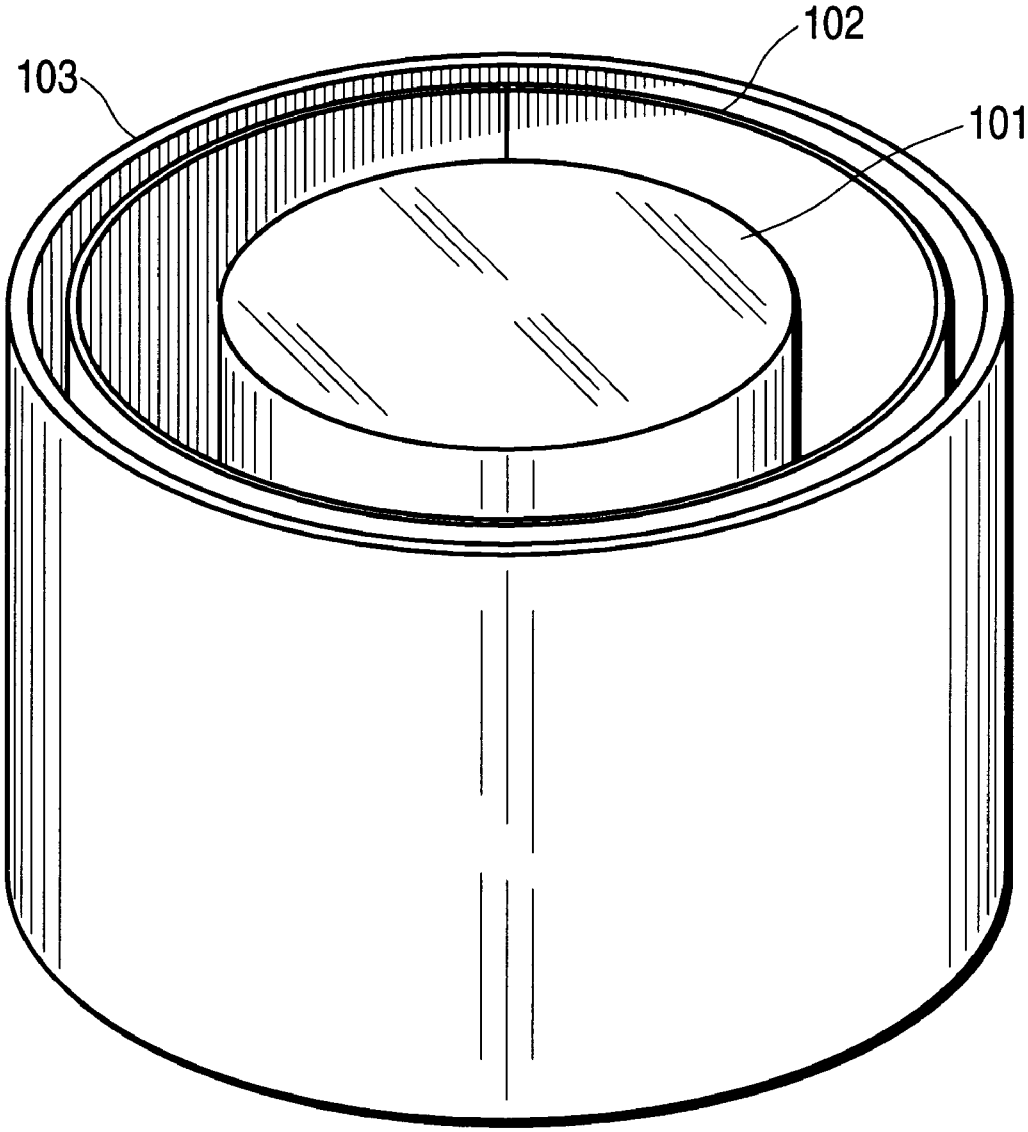
FIG. 1 is a perspective view of an antenna disposed within a housing around an electronic device in accordance with the present invention.

With reference now to FIG. 1, antenna housing 103 is roughly cylindrical and encloses antenna 102. Electronic Package 101 is disposed within housing 103 such that electronics package 101 is surrounded along it's side surface by antenna 102. In one embodiment electronics package 101 is a data receiver for a GPS system.

In one embodiment antenna 102 is placed around an electronics package which is a GPS position determination system. In one embodiment the GPS position determination system includes a GPS receiver which broadcasts and receives signals through the antenna so as to share satellite observables and correction data for accurately determining position. These communications may be used to determine position using differential global positioning (DGPS) methods and using real time kinematic (RTK) methods.

Figure 2:
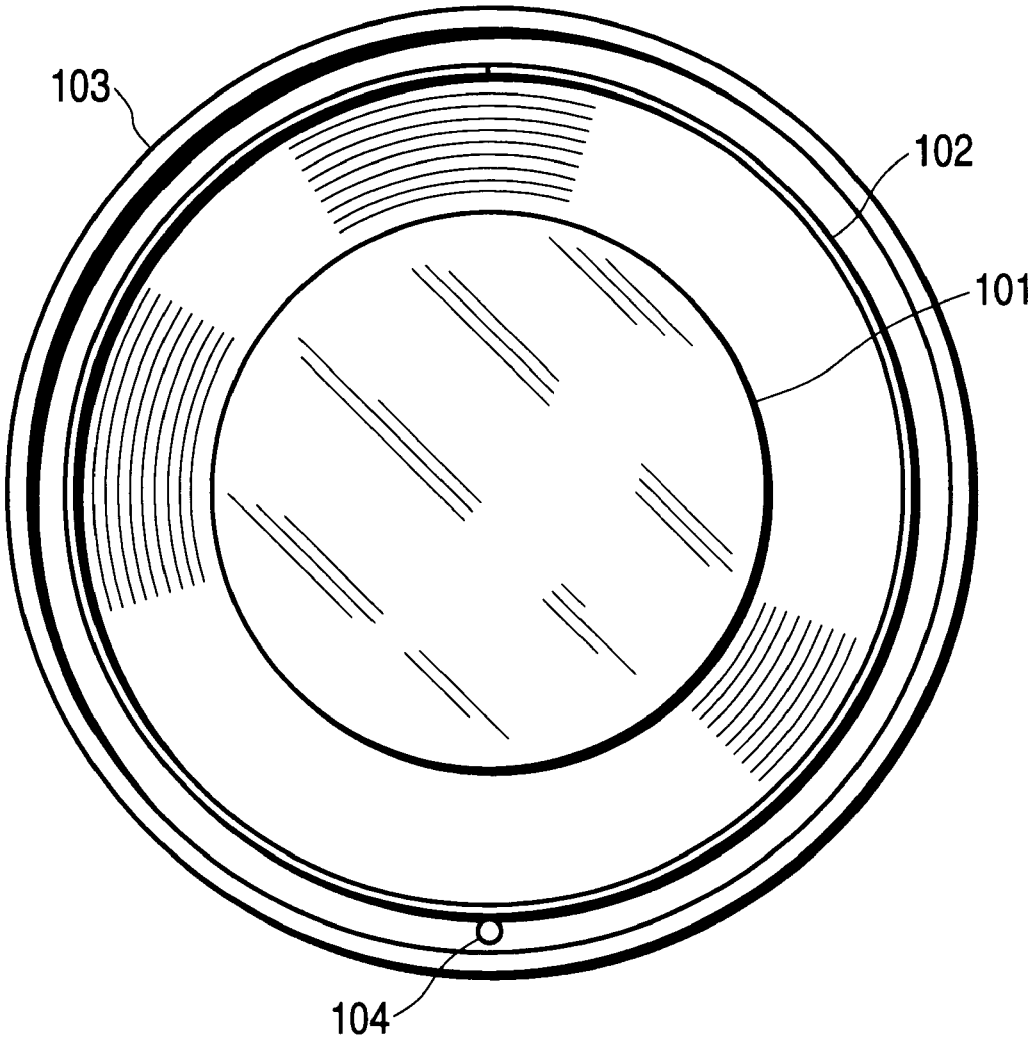
FIG. 2 is a top view of an antenna disposed within a housing around an electronic device in accordance with the present invention.

FIG. 2 shows a top view of the structure of FIG. 1. Antenna 102 is powered via cable 104 which is connected to antenna 102. Cable 104 may be connected to antenna 102 by any of a number of known methods such as soldering, brazing, or welding the conductive wires of cable 104 to antenna 102.

Figure 3A:
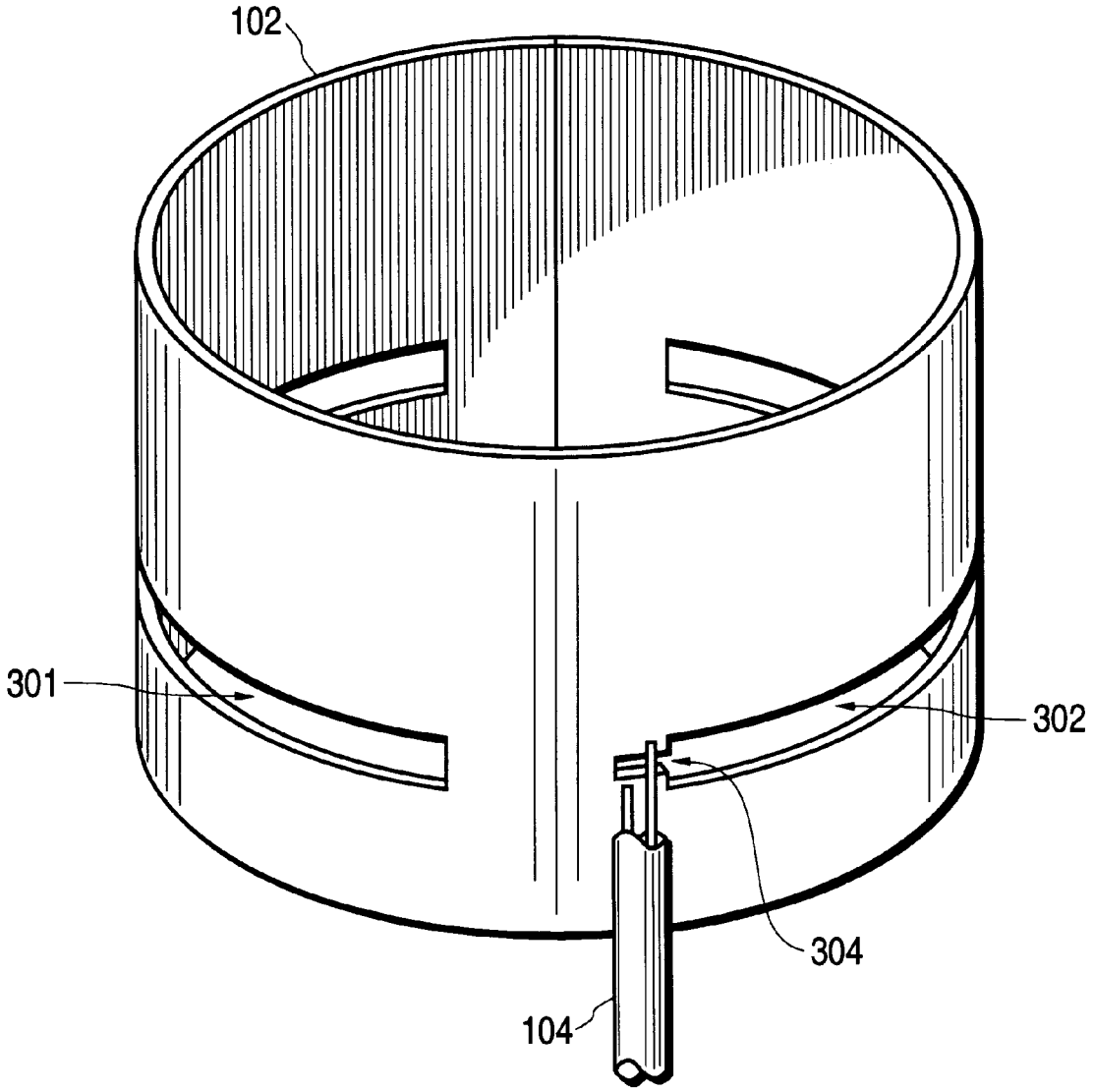
FIG. 3A is a perspective view of an antenna in accordance with the present invention.

FIG. 3A shows an antenna 102 to include slots 301–302. It can be seen that slots 301–302 extend around antenna 102. The length of slots 301–302 is roughly half of the wavelength for the frequency at which the antenna is to be operated. Slot 302 includes launching section 304 across which antenna 102 is powered via antenna cable 104 at a power feed point.

Figure 3B:
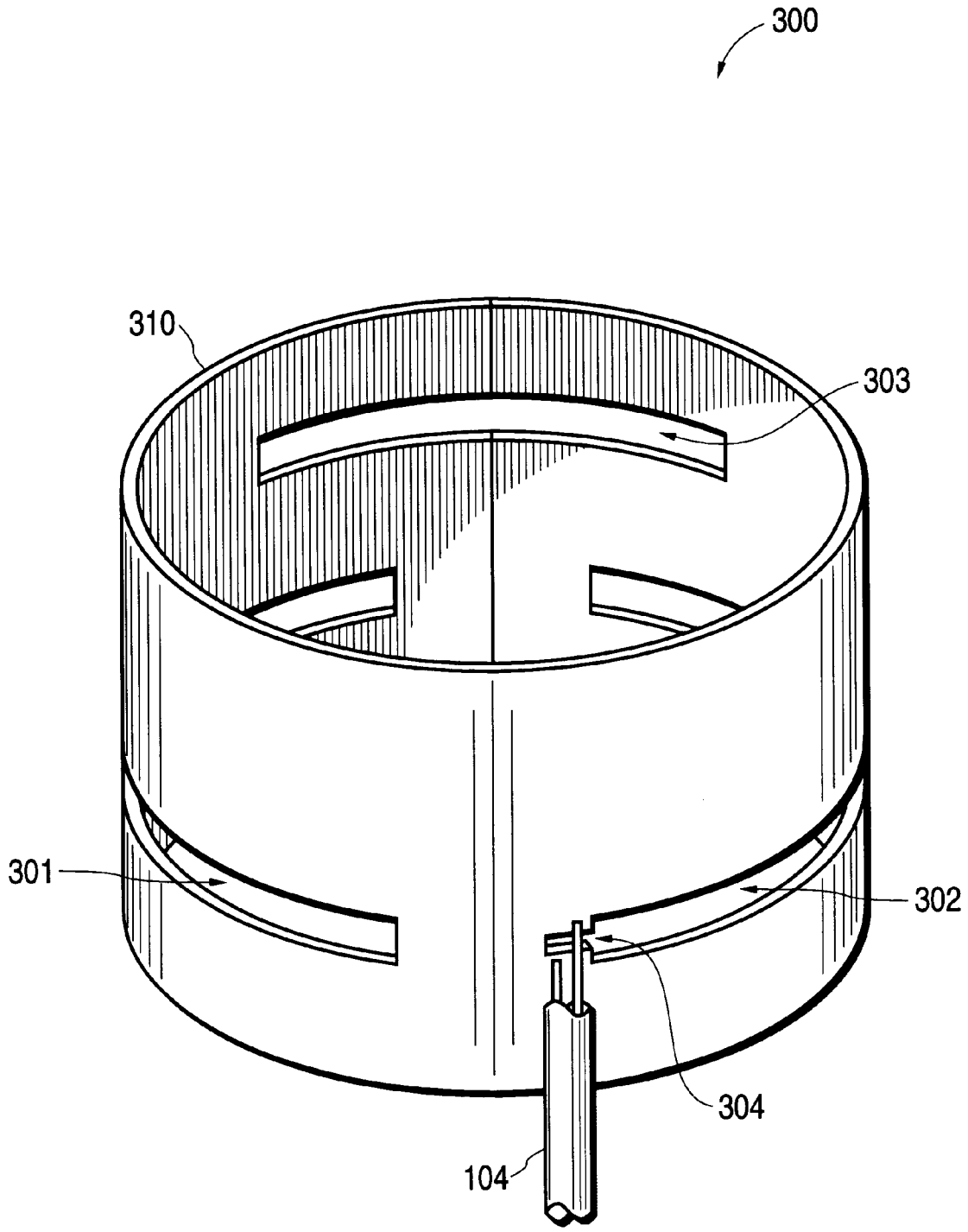
FIG. 3B is a perspective view of an antenna in accordance with the present invention.

FIG. 3B shows an antenna 300 which includes three slots. Antenna 300 of FIG. 3B is shown to include slots 301–302, as shown in the embodiment illustrated in FIG. 3A and a third slot, slot 303. It can be seen that slots 301–303 extend around antenna 300. The length of slots 301–303 is roughly half of the wavelength for the frequency at which the antenna is to be operated. Slot 302 includes launching section 304 across which antenna 300 is powered via antenna cable 104 at a power feed point.

With reference to FIG. 3B, in one embodiment of the present invention, an antenna strip 310 having a height of 3.25 inches and a length of 22 inches is used. In this embodiment slot 301 has a height of 0.7 inches and a length of 7.75 inches, and slot 302 has a height of 0.7 inches and a length of 11 inches and launching section 304 has a height of 0.4 inches and a length of 1.5 inches and is powered 0.8 inches from its closed end through antenna cable 104 such that slots 301 and slot 302 are separated by a distance of 6.25 inches. In this embodiment, slot 303 has a length of 8.6 inches and a height of 0.35 inches. In this embodiment, antenna 300 radiates at a frequency of 450 MegaHertz.

Figure 4:
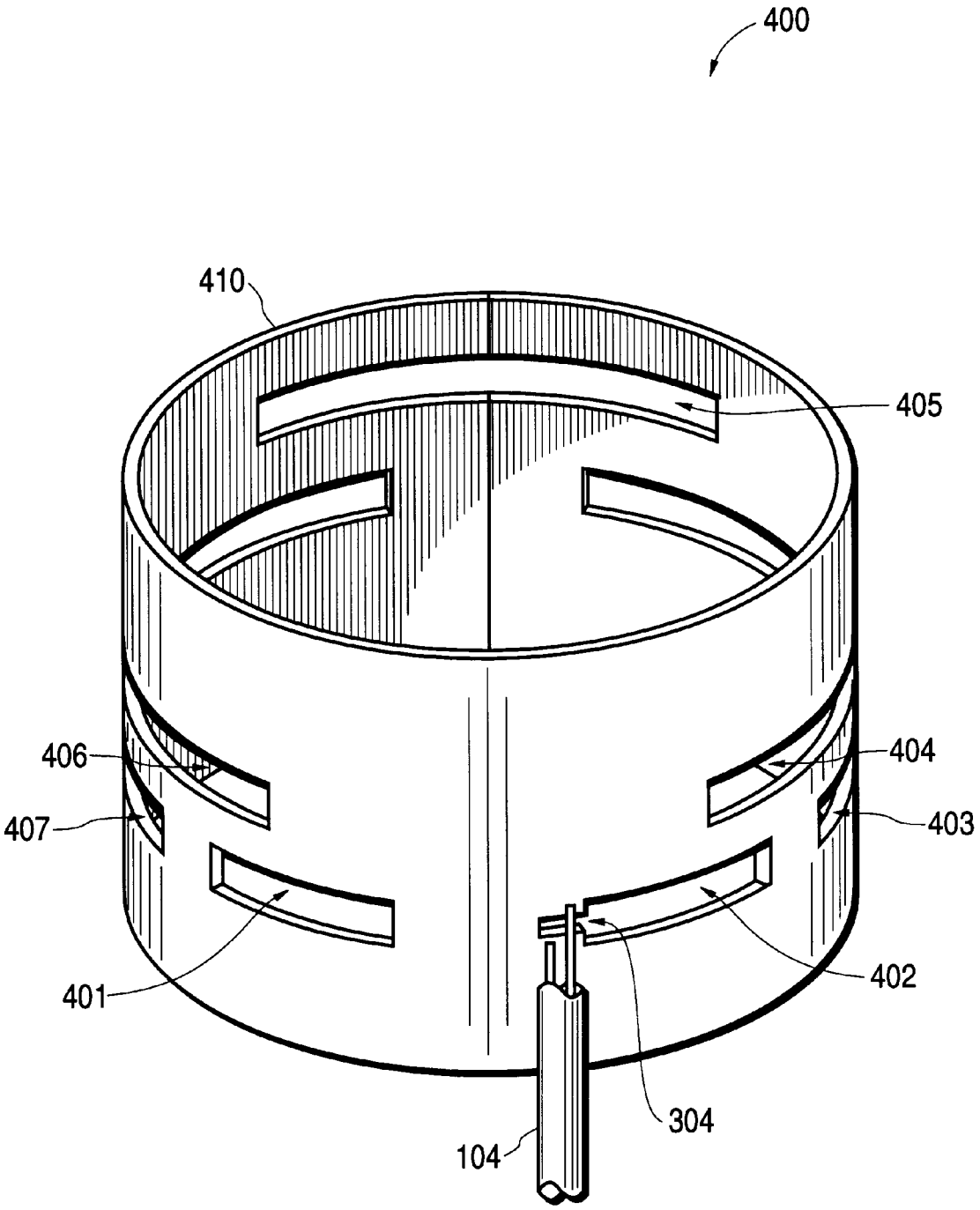
FIG. 4 is a perspective view illustrating an antenna in accordance with the present invention.

FIG. 4 shows an antenna which is designed to fit within a larger diameter of enclosure. A larger diameter enclosure may be dictated by the size of the electronics package or the physical requirements of any particular system. Antenna 400 may be easily configured to accommodate a given size of enclosure or size of electronics package. This is accomplished by increasing the number of slots to accommodate the size of the system. In antenna 400, the number of slots has been increased to six as shown by slots 401–407. The radiation characteristics of antenna 400 are obtained by adjusting the location and size of slots 401–407 and by adjusting the location at which power is supplied to antenna 400.

Figure 5:
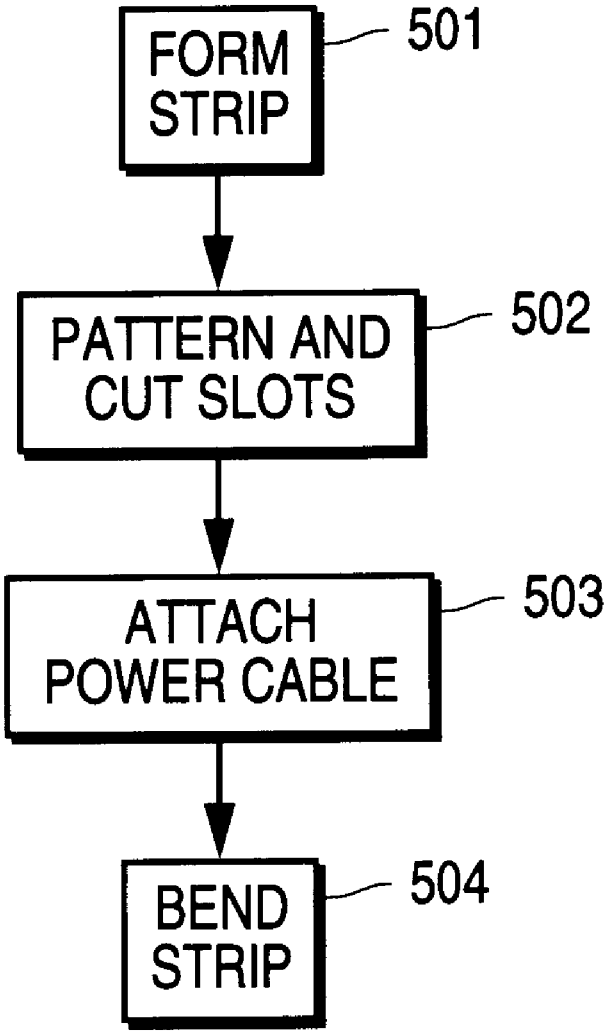
FIG. 5 is a diagram of the steps for forming an antenna in accordance with the present invention.

FIG. 5 shows the steps required to form an antenna radiating at a desired wavelength azimuthally which conforms to any required size requirement. First, as shown by box 501, a strip is formed in the height and length required to conform to the particular system. As shown by box 502, the antenna is then patterned and slots having the required sizes are cut into the strip. The power cable is then attached to the antenna as shown by block 503. The strip is then bent into the desired shape as shown by block 504. The antenna is then inserted into the antenna housing and power is applied to the antenna so as to produce a toroidal radiation pattern. In one embodiment, the length of each slot is one half of a wavelength. In order to produce a toroidal radiation pattern slots must be disposed around the circumference of the antenna such that no part of the circumference greater than 60 degrees (out of 360 degrees) is devoid of slots. Thus, as long as slots cover at least 300 degrees radially along the azimuth, the antenna will radiate toroidally.

Figure 6:
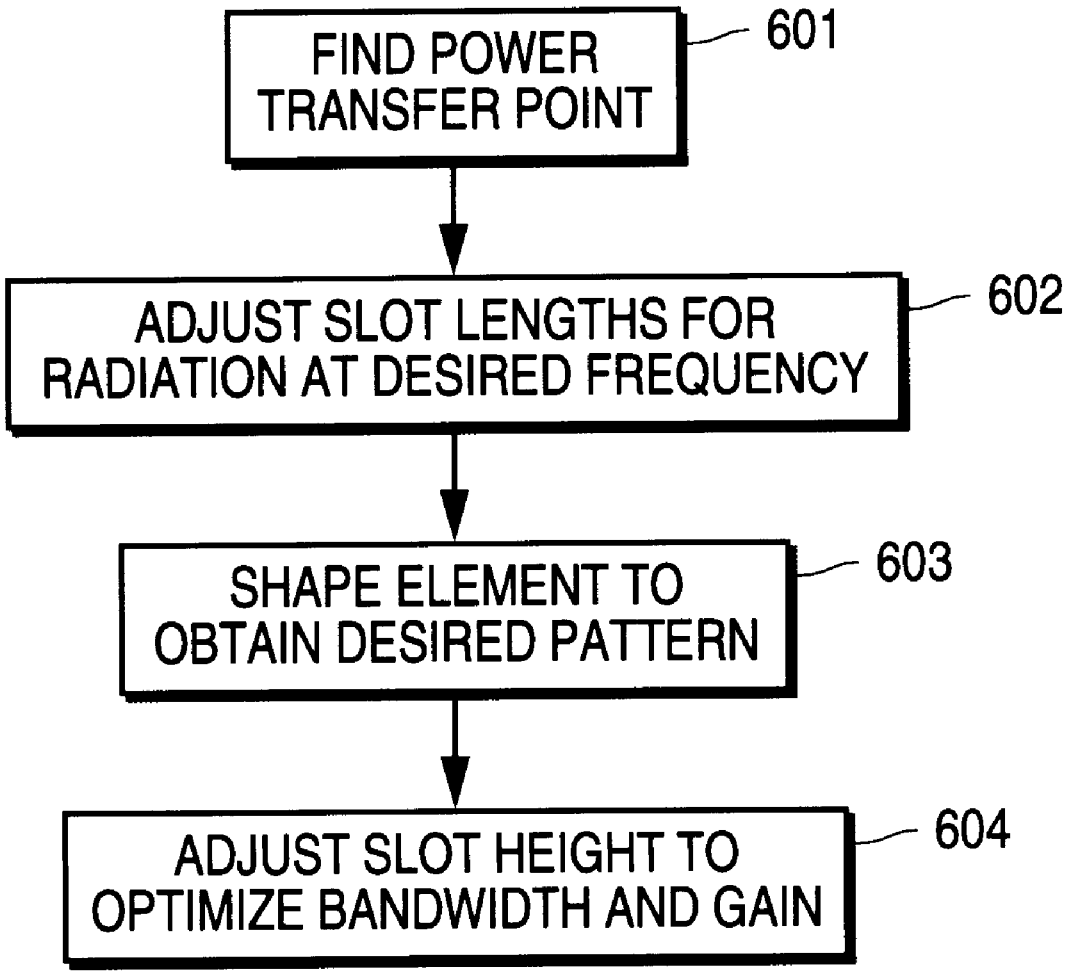
FIG. 6 is a diagram of the steps for tuning an antenna in accordance with the present invention.
Figure 7A:
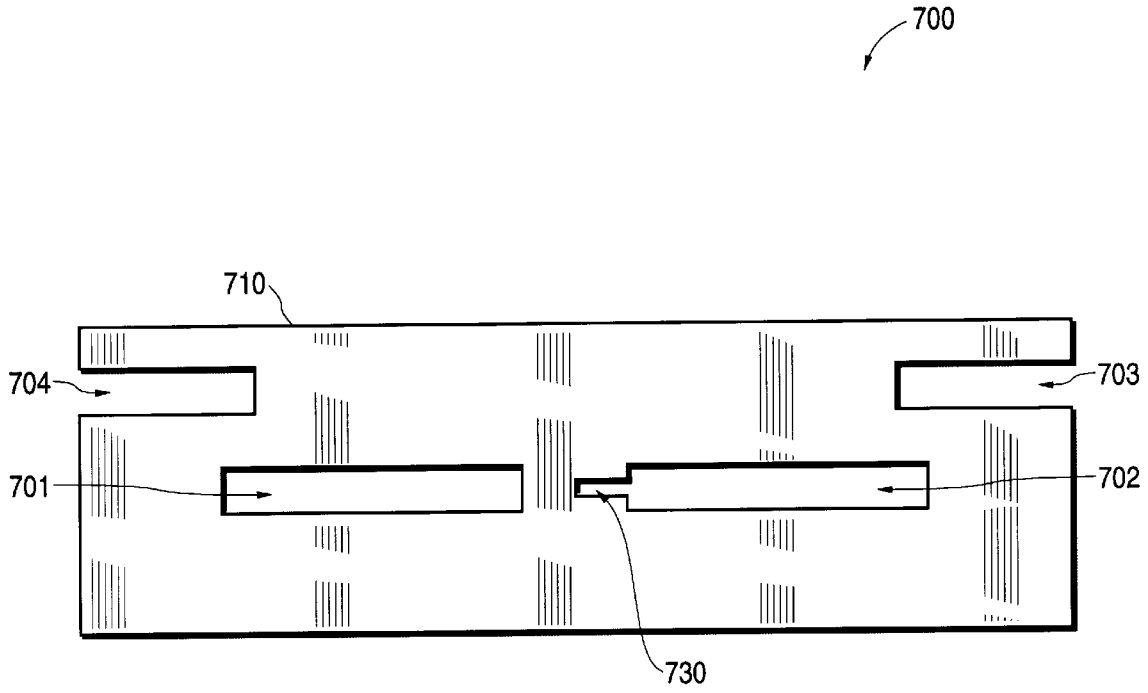
FIG. 7A is a diagram illustrating an antenna pattern for an antenna in accordance with the present invention.

As shown in FIG. 6, the antenna is tuned in order to determine the size of slots for any desired frequency and desired bandwidth and gain. First, as shown by block 601, a power transfer point is determined. FIG. 7A shows antenna 700 to include copper strip 710 and slots 701–702 and slot segments 703–4. In one embodiment a transition area is formed on one end of a slot and the power transfer point is located along the transition area. FIG. 7A shows transition area 730 formed on one end of slot 702. The power transfer point is determined by impedance matching using well known techniques. In one embodiment the power transfer point is determined by adjusting the position of the power transfer point until such time that an impedance match of 50 ohms is obtained. Once the power transfer point is determined, a cable is attached to opposite sides of the transition area at the power transfer point. Power is then applied to the antenna cable and the frequency of the radiation from each slot is monitored.

The size of slots may also be determined using the perimeter of each slot. With reference to slots having a height and a length, the size of the slots may be determined by adjusting the length and height such that the perimeter is one wavelength. In one embodiment, once the length of a slot is determined, the height is determined by subtracting twice the length of the slot from the desired wavelength and dividing by two.

Figure 7B:
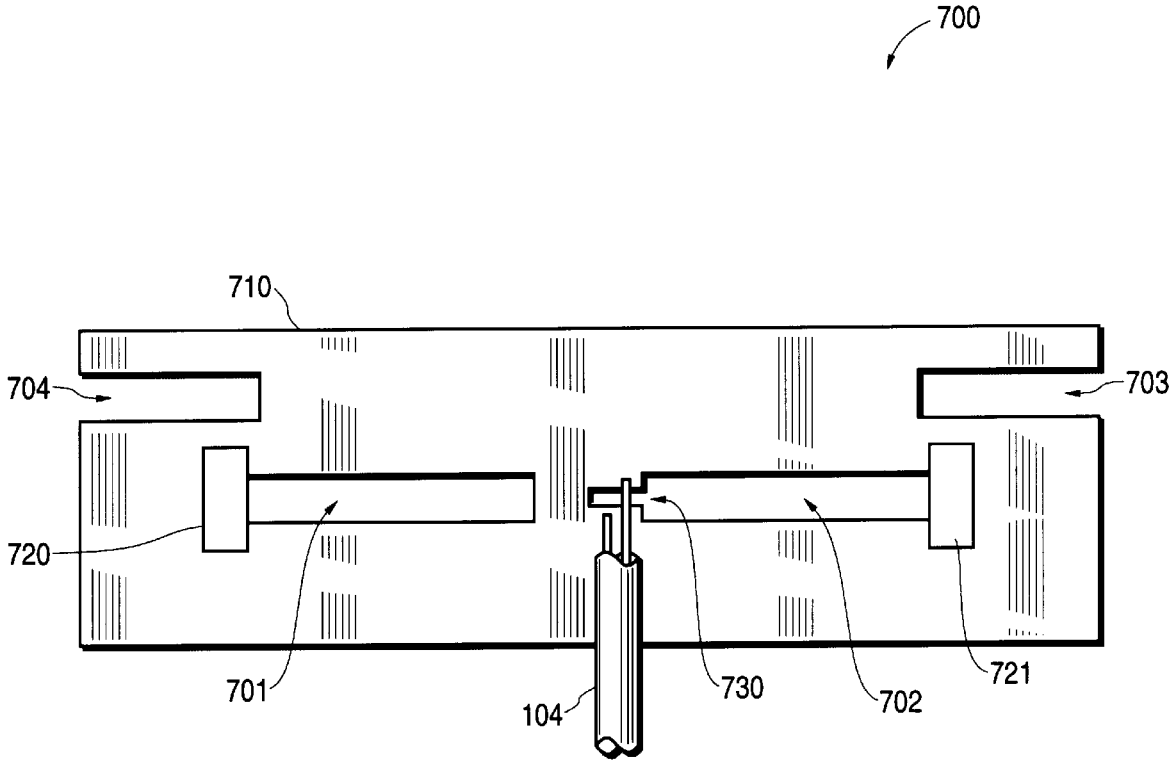
FIG. 7B is a diagram illustrating an antenna pattern for an antenna disposed around an electronic device in accordance with the present invention.
Figure 7C:
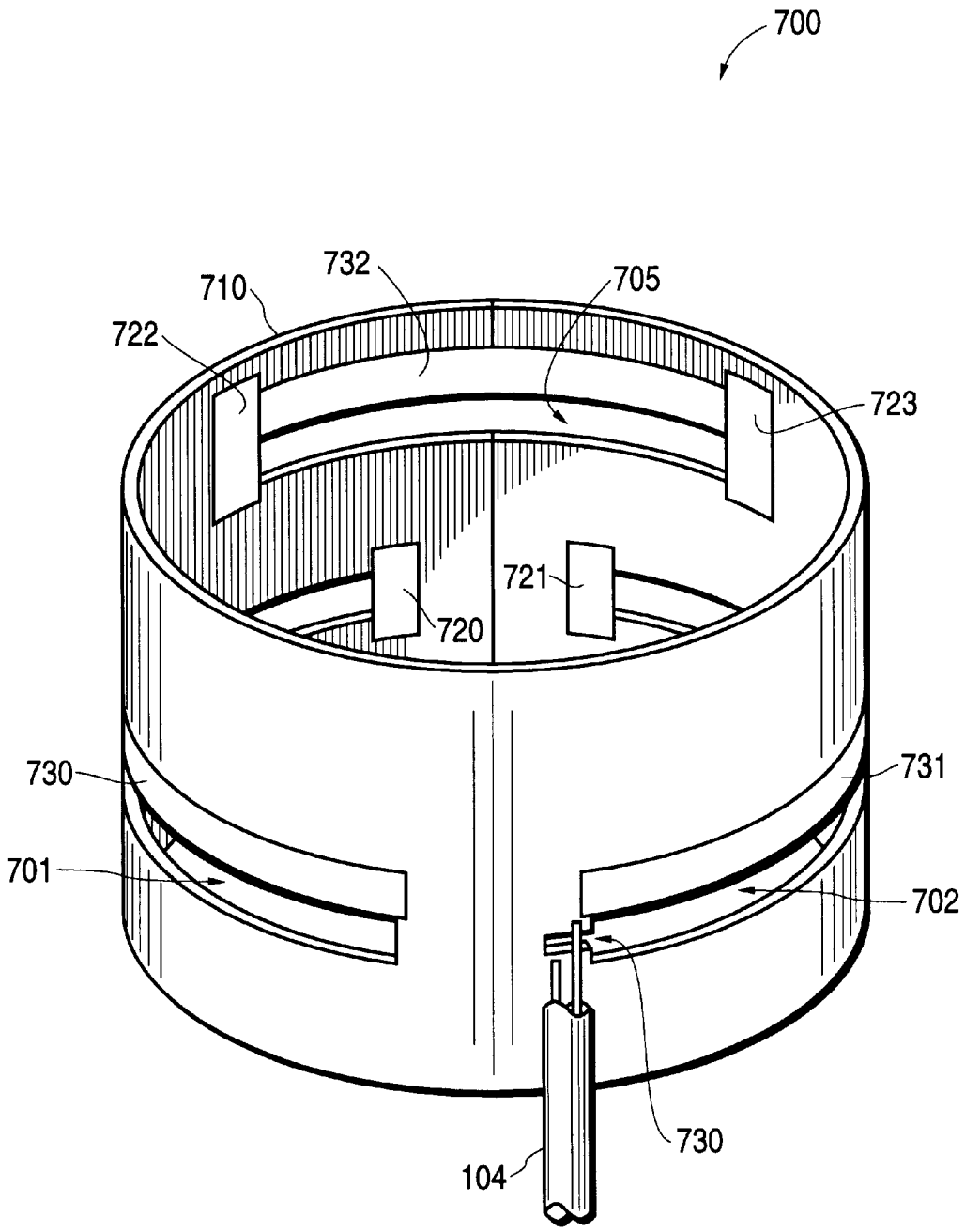
FIG. 7C is a diagram illustrating an antenna pattern for an antenna disposed around an electronic device in accordance with the present invention.

The antenna is configured to radiate at the desired frequency by placing copper tape over each slot as required to adjust the length of each slot such that the slot radiates at the desired frequency as shown by block 602 of FIG. 6. FIG. 7B shows an antenna 700 which is formed by cutting slots 701 and slot 702 and slot segments 703–704 in copper strip 710. In one embodiment, frequency is adjusted by placing copper tape piece 720 over one end of slot 701 such that slot 701 radiates at the desired frequency and by placing copper tape piece 721 over one end of slot 702 such that slot 702 radiates at the desired frequency. The antenna is then bent into the desired shape as shown by box 603 of FIG. 6. In one embodiment, the desired shape is cylindrical and the shape is obtained by bending the antenna strip into a complete circle such that electrical contact is made across opposite ends of the conductive strip. FIG. 7C shows the structure of FIG. 7B after antenna strip 710 is bent into a complete circle. FIG. 7C shows antenna cable 104 to be connected to antenna strip 710 such that power is applied to a power transfer point corresponding to the contact points of wires emanating from cable 104 which connect to opposite sides of start region 730. Copper tape is then used to configure any slot that is not complete when the conductive strip is laid flat such that the slot resonates at the desired frequency. In the embodiment shown in FIG. 7A–7B, slot segments 703–704 combine to form slot 705 In this embodiment, copper tape pieces 722–723 are applied so as to determine the proper length for slot 705. As shown by block 604 of FIG. 6, copper tape is then used to adjust the height of each slot such that each slot radiates at the desired bandwidth and gain. FIG. 7C shows the structure of FIG. 7B after copper tape pieces 730–732 have been applied to copper strip 710 so as to reduce the height of slots 701–702 and 705.

Figure 8:
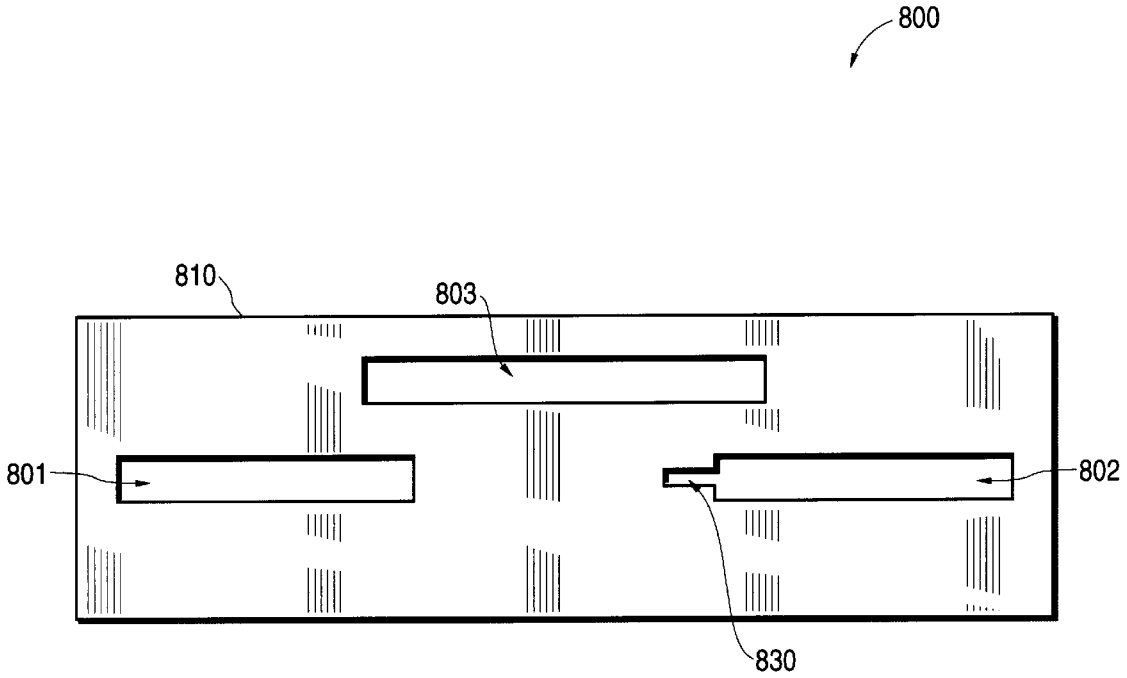
FIG. 8 is a perspective view of an antenna strip in accordance with the present invention.

In an alternate embodiment, slots are formed such that no slot segments (incomplete slots) are formed. This may be accomplished, for example, by forming the slot structure shown in FIGS. 7A–7C on strip 710 such that the strip is joined between slots 701 and slot 702, making slot 705 complete. This embodiment is shown in FIG. 8. Slots 801–803 of antenna 800 are not broken by the end of copper strip 810. This allows for easier assembly of antenna 800 since there are no slot segments to match up.

Once the locations for each slot are determined and the size of each slot is configured to obtain the desired radiation frequency, bandwidth and gain, subsequent antennas may be formed by duplicating the dimensions and relevant locations (slot locations and power transfer location). Antennas may be mass produced which have the desired radiation characteristics (frequency, bandwidth and gain) by forming conductive strips having the required dimensions. The conductive strips then need only be placed around the electronics package and connected at the designated contact point.

Thus, for any configuration of system, an antenna may be formed which will radiate a vertically polarized toroidal signal. Though the present invention is described with reference to the transmission of data for DGPS and RTK systems which determine position using signals from GPS satellites, the present invention may be used in any type of system and for any type of product which requires a toroidal radiation pattern. For example the present invention is well suited for use in a hand held radio transmitter, receiver, or transmitting and receiving unit. In addition, the present invention is well suited to any type of radio that is used in conjunction with an electronic package.

In one embodiment, a single driven slot may be used which extends around the circumference of the antenna. In this embodiment, the length of the slot is roughly one wavelength. However, depending on the size of the antenna, one slot may not be sufficient to obtain the required gain.

In a second embodiment, two slots, a driven slot and a parasitic slot are disposed in the antenna. In this embodiment, the first and second slots are not separated at any point by more than 60 degrees azimuthally in order to obtain a toroidal radiation pattern.

Figure 9A:
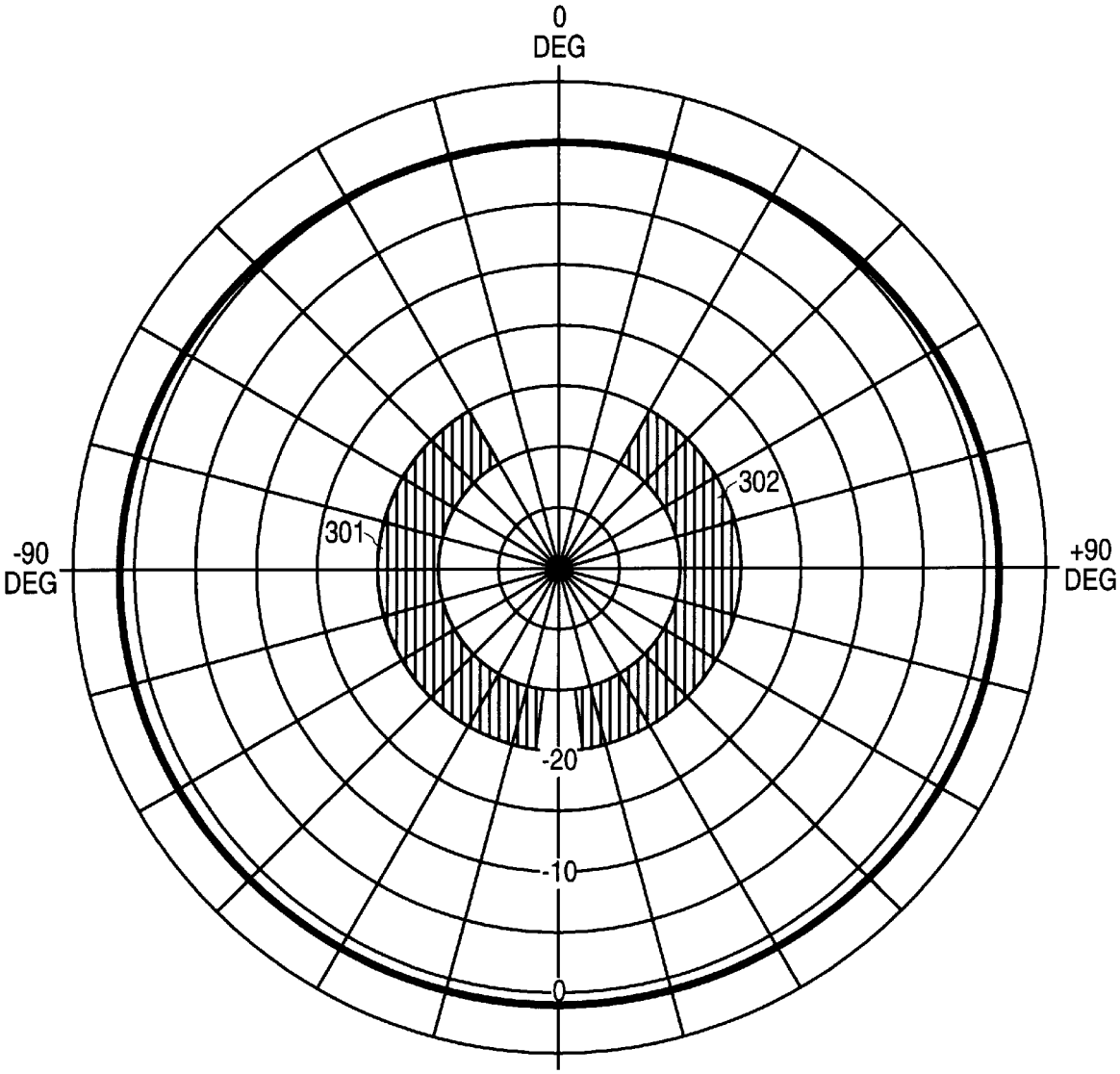
FIG. 9A is a diagram showing antenna slots and a radiation pattern in accordance with the present invention.

The process discussed with reference to FIGS. 5–6 may also be used to compensate for reflection such that the antenna may be placed closer than one quarter wavelength from the electronic package. However, in the embodiment where one or two slots are used, the interference from the electronics package distorts the radiation pattern. FIG. 9A shows a radiation pattern resulting from the structure of FIG. 3A when antenna 102 is radiating without interference from an electronics package. It can be seen that this structure includes slot 301 and slot 302 which are separated on one side by sixty degrees azimuthally and which are separated on the opposite side by less than ten degrees. The radiation pattern is toroidal in spite of the wide separation between slot 301 and slot 302 (60 degrees).

Figure 9B:
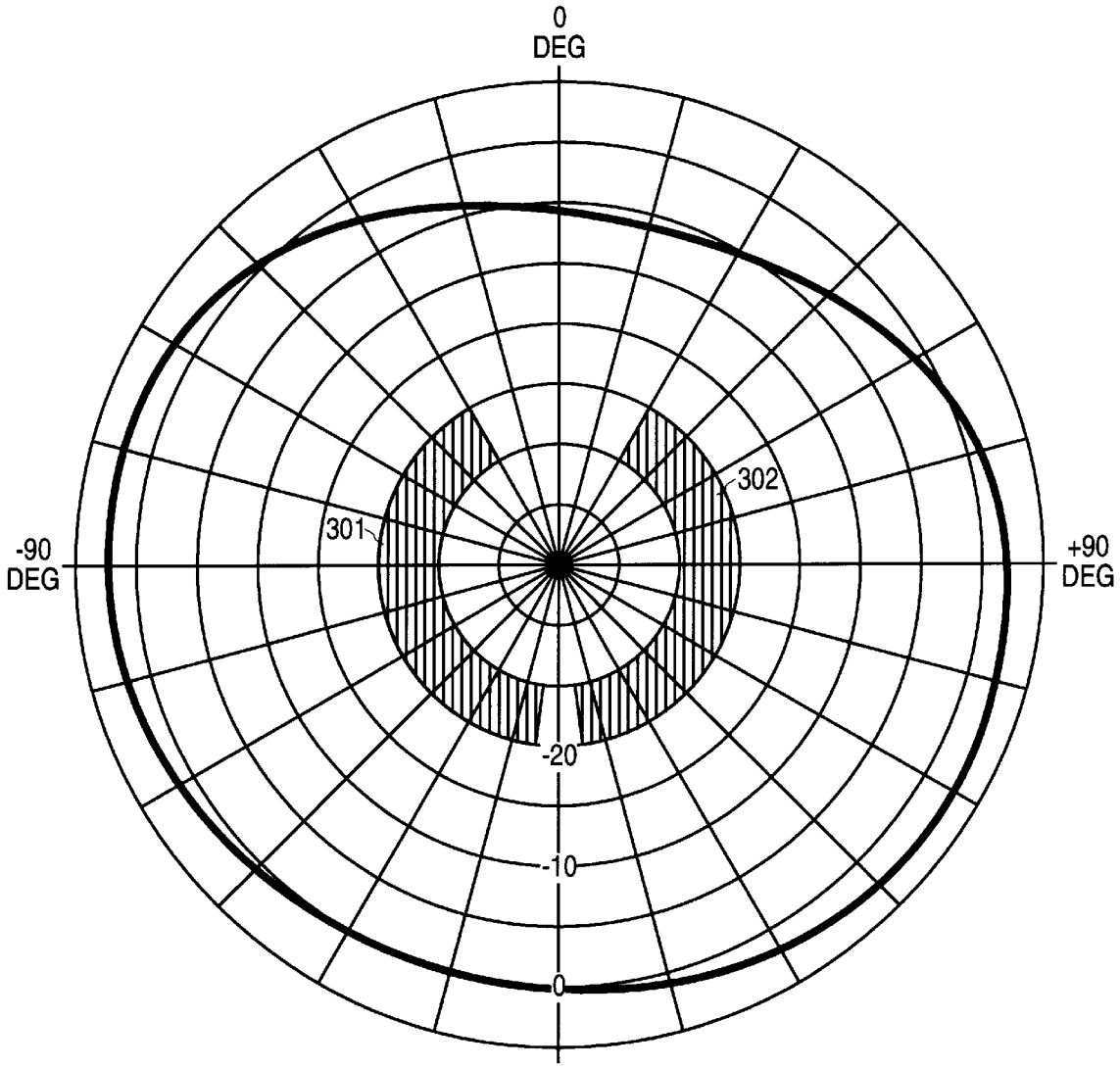
FIG. 9B is a diagram showing antenna slots and a radiation pattern in accordance with the present invention.
Figure 9C:
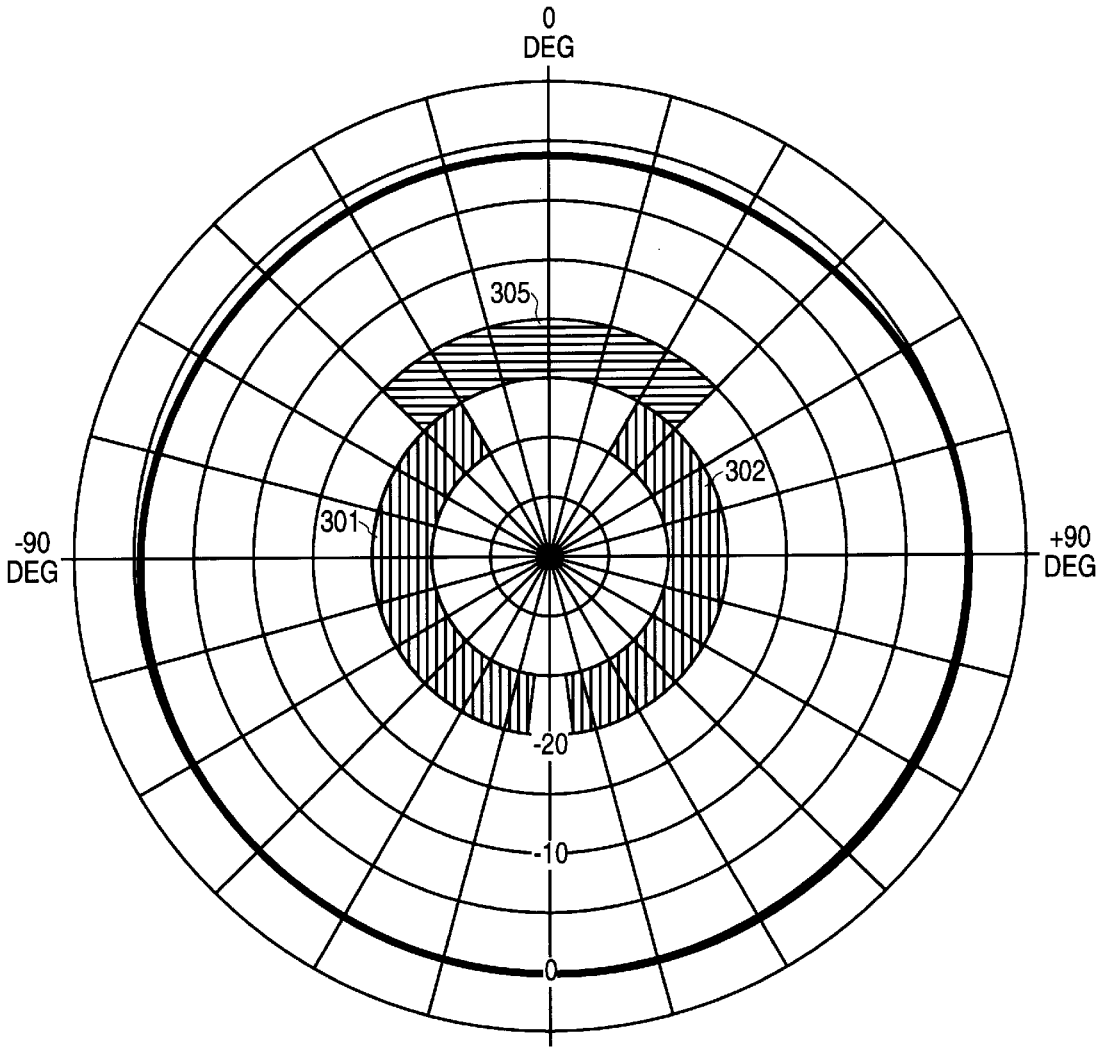
FIG. 9C is a diagram showing antenna slots and a radiation pattern in accordance with the present invention.

FIG. 9*b* shows the antenna pattern resulting from the insertion of an electronics package within antenna 300 of FIG. 3A such that the electronics package is closer than one quarter of a wavelength to the antenna. It can be seen that the electronics package distorts the radiation pattern. Thus, though the two slots are separated by 60 degrees or less, the radiation pattern is not toroidal. In order to correct this distortion, an additional slot is added to the antenna. In the situation where two slots are disposed in the antenna strip, a third slot is added over the region in which distortion is observed. This process results in the antenna structure shown in FIG. 3B. The addition of the third slot gives the radiation pattern shown in FIG. 9C. Slot 305 extends across the gap between slot 301 and slot 302. It can be seen that the radiation pattern is again toroidal. Thus, the present invention allows for the correction of interference such that an antenna according to the present invention may be placed closer than one quarter wavelength form an electronics package and may still radiate toroidally.

The antenna radiation pattern is herein described with reference to a toroidal shape. Other characteristics of the radiation pattern include the fact that the antenna radiates throughout a azimuthal axis of 360 degrees and the radiation strength is relatively constant throughout the entire 360 degree azimuth. The amplitude of the resulting signal is constant throughout a 360 degree azimuth extending horizontally from the antenna. The resulting signal exhibits a signal which is constant around a 360 degree azimuth for each angle extending along a vertical axis up from a center horizontal axis representing 0 degrees vertically from the antenna up to a vertical angle of about 45 to 50 degrees and downward to a vertical angle of about 45–50 degrees. At angles from 50 degrees to 90 degrees the resulting signal drops off to 0 at an angle of 90 degrees both above and below the center horizontal axis. The resulting radiation pattern is substantially constant in the horizontal plane for any azimuthal angle. With reference to a cylindrically shaped slotted antenna formed around a central axis, the resulting antenna may also be described as having a relatively constant pattern azimuthally in planes running perpendicularly through the central axis.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. For example, though a system which includes rounded parts is shown, hexagonal, octagonal or other similar geometric shapes would give adequate results. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

We claim:

1. A vertically polarized antenna conforming to the size requirements of a system comprising:

an electronics package including provision for generating a radio signal;

a flexible conductive strip disposed within said system such that said flexible conductive strip is disposed cylindrically so as to extend around an arc of greater than 300 degrees, said flexible conductive strip including a plurality of slots disposed longitudinally therein, said plurality of slots including a driven slot and a plurality of parasitically driven slots; and an antenna cable electrically coupled to said electronics package and electrically coupled to said driven slot such that, upon the application of power to said antenna cable, power is applied to said driven slot, said power applied to said driven slot parasitically driving said plurality of parasitically driven slots such that said flexible conductive strip radiates in a pattern that is substantially constant in the horizontal plane for any azimuthal angle for transmitting said radio signal.

2. The antenna of claim 1 wherein said flexible conductive strip has a length and a height and wherein said plurality of slots have a length and a height, said length and height of said flexible conductive strip conforming to the size and geometry of said system, the length and height of said plurality of slots determined so as to produce a vertically polarized toroidal radiation pattern which conforms with the desired electronic characteristics of said antenna.

3. The antenna of claim 2 wherein said electronic characteristics include an operating frequency, such that said antenna is tuned for resonance at the desired operating frequency by selecting an area for each of said slots such that said antenna resonates at the desired operating frequency.

4. The antenna of claim 1 wherein said flexible conductive strip has a shape conforming to the shape of said system.

5. The antenna of claim 1 wherein said flexible conductive strip extends around said electronics package extending around said azimuthal arc such that each of said plurality of slots are not separated from an adjoining slot by more than 60 degrees such that said plurality of slots generate a toroidal radiation pattern extending 360 degrees around said azimuthal arc.

6. The antenna of claim 5 wherein said driven slot includes a launching section and wherein said antenna cable is connected to said driven slot across said launching section.

7. The antenna of claim 6 wherein said flexible conductive strip comprises copper.

8. The antenna of claim 1 wherein said flexible conductive strip has a front surface and a back surface, said antenna further comprising a dielectric layer coupled to said back surface of said flexible conductive strip for adding structural support.

9. The antenna of claim 1 wherein said flexible conductive strip is disposed cylindrically.

10. An electronic device comprising:

a housing;

an electronics package disposed within said housing and including provision for generating a radio signal;

an antenna cable electrically coupled to said electronics package and disposed within said housing; and a flexible conductive strip disposed around said electronics package and within said housing, said flexible conductive strip including a plurality of slots disposed longitudinally therein, said plurality of slots including a driven slot and a plurality of parasitically driven slots, said antenna cable electrically coupled to said driven slot such that, upon the application of power to said antenna cable, power is applied to said driven slot, said power applied to said driven slot parasitically driving said parasitically driven slots such that said flexible conductive strip radiates in a pattern that is substantially constant in the horizontal plane for any azimuthal angle for transmitting said radio signal.

11. The antenna of claim 10 wherein each of said plurality of slots are not separated from an adjoining slot by more than 60 degrees in an azimuthal arc.

12. The antenna of claim 10 wherein said driven slot includes a launching section and wherein said antenna cable is connected to said antenna across said launching section.

13. The antenna of claim 12 wherein said flexible conductive strip comprises copper.

14. A method for forming a vertically polarized antenna that conforms to the geometry of a system comprising:

a) forming a flexible conductive strip that has a plurality of slots disposed therein, said plurality of slots including a driven slot and a plurality of parasitically driven slots, said plurality of slots disposed longitudinally across said flexible conductive strip;

b) providing an electronics package including provision for generating a radio signal;

c) bending said flexible conductive strip such that it extends in a azimuthal arc around said electronics package more than 300 degrees; and d) providing an antenna cable electrically coupled to said electronics package and electrically coupled to said driven slot such that, upon the application of power to said antenna cable, power is applied to said driven slot, said power applied to said driven slot parasitically driving said parasitically driven slots such that said flexible conductive strip radiates in a pattern that is substantially constant in the horizontal plane for any azimuthal angle for transmitting said radio signal.

15. The method for forming an antenna of claim 14 wherein step d) further comprises:

connecting an antenna cable to said flexible conductive strip such that said antenna cable is electrically connected to opposite sides of said driven slot.

16. The method for forming an antenna of claim 15 wherein the height and length of each of said plurality of slots is determined by tuning said antenna, said tuning process further comprising the steps of:

altering the length of each of said plurality of slots so that said antenna resonates at the desired frequency; and altering the height of each of said plurality of slots such that said antenna resonates at the desired bandwidth.

17. The method for forming an antenna of claim 15 wherein, upon the application of power to said flexible conductive strip, said flexible conductive strip radiates so as to generate a radiation pattern, said method of forming an antenna further comprising the step of:

altering the length and height of ones of said plurality of slots so as to compensate for the distortion in the radiation pattern caused by said electronics package.

18. The method for forming an antenna of claim 14 wherein said flexible conductive strip is disposed cylindrically around said electronics package.

* * * * *